US005628482A

United States Patent [19]

Iravantchi et al.

[11] Patent Number: 5,628,482

[45] Date of Patent: May 13, 1997

[54] KEYBOARD STORAGE DEVICE ASSEMBLY

[75] Inventors: Sam Iravantchi, Rossmoor; Douglas Walker, Long Beach, both of Calif.

[73] Assignee: Rubbermaid Office Products Inc., Maryville, Tenn.

[21] Appl. No.: 512,843

[22] Filed: Aug. 10, 1995

[51] Int. Cl.[6] ..... B68G 5/00

[52] U.S. Cl. ..... 248/118; 108/143; 248/918

[58] Field of Search ..... 248/118, 118.1, 248/917, 918, 924, 281.11, 448, 346.07, 285.1, 286.1; 108/143; 312/208.1

[56] References Cited

U.S. PATENT DOCUMENTS

| | | | |
|---|---|---|---|
| D. 342,242 | 12/1993 | Hassel et al. | D14/114 |
| D. 344,652 | 3/1994 | Hatcher | D6/511 |
| 3,830,352 | 8/1974 | Kolpek | 197/186 |
| 4,313,112 | 1/1982 | Foster | 340/700 |
| 4,316,082 | 2/1982 | Fritz | 235/146 |
| 4,325,657 | 4/1982 | Little et al. | 108/93 |
| 4,384,532 | 5/1983 | Staff | 108/72 |
| 4,481,556 | 11/1984 | Berke et al. | 361/222 |
| 4,483,572 | 11/1984 | Story | 312/196 |
| 4,496,200 | 1/1985 | Hagstrom et al. | 312/308 |
| 4,511,111 | 4/1985 | Godfrey et al. | 248/459 |
| 4,616,798 | 10/1986 | Smeenge et al. | 248/281.11 |
| 4,635,893 | 1/1987 | Nelson | 248/558 |
| 4,691,888 | 9/1987 | Cotterill et al. | 248/284.1 |
| 4,693,444 | 9/1987 | Williams et al. | 248/653 |
| 4,704,604 | 11/1987 | Fuhs | 340/700 |
| 4,706,919 | 11/1987 | Soberalski et al. | 248/281.11 |
| 4,709,972 | 12/1987 | LaBudde et al. | 312/208.1 |
| 4,717,112 | 1/1988 | Pirkle | 248/639 |
| 4,718,740 | 1/1988 | Cox | 312/208.1 |
| 4,776,284 | 10/1988 | McIntosh | 108/138 |
| 4,862,140 | 8/1989 | Schriner | 248/639 |
| 4,863,124 | 9/1989 | Ball et al. | 108/28 |
| 4,901,972 | 2/1990 | Judd et al. | 248/918 |
| 4,946,121 | 8/1990 | Troke | 248/201 |
| 4,988,066 | 1/1991 | Cotterill | 248/281.11 |
| 5,033,707 | 7/1991 | Strater | 248/284.1 |
| 5,037,054 | 8/1991 | McConnell | 248/286.1 X |
| 5,040,760 | 8/1991 | Singer | 248/284.1 |
| 5,062,609 | 11/1991 | Hames et al. | 248/676 |
| 5,098,053 | 3/1992 | Cotterill | 248/281.11 |
| 5,201,485 | 4/1993 | Moss et al. | 248/118 |
| 5,211,367 | 5/1993 | Musculus | 248/279.1 |
| 5,219,136 | 6/1993 | Hassel et al. | 248/118 |
| 5,281,001 | 1/1994 | Bergsten et al. | 248/118 X |
| 5,302,015 | 4/1994 | DuVall | 312/282 |

OTHER PUBLICATIONS

Page 485, 486 and 487, Keyboard storage devices; United Stationers, 2200 East Golf Road, Des Plaines, Illinois 60016. Publication date Sep., 1991.

Sell sheet, Keyboard storage devices; Fast Channel Co., Ltd., P. O. Box 57–67, Taipei, Taiwan, R.O.C. Published at least as early as 1994.

Sell sheet, Keyboard storage devices; Chen–Source Inc., 12–2Fl., No. 28, Hang Chou N. Rd., Taipei, Taiwan, R.O.C. Published at least as early as 1991.

Pages 14, 15, 16, 18, 19 and 20, Keyboard storage devices, Microcomputer Accessories, Inc., 5405 Jandy Place, P.O. Box 66911, Los Angeles, California 90066. Publication date Nov., 1992.

*Primary Examiner*—Ramon O. Ramirez

*Attorney, Agent, or Firm*—Richard B. O'Planick; Lisa B. Riedesel

[57] ABSTRACT

A keyboard storage device assembly of parallelogram shape is disclosed comprising first and second arms (18, 20), and first and second parallel platform housing arms (12, 14), each having an inner channel (42) axially receiving the arms (18, 20) therein with the arms (18, 20) moving reciprocally within the channels (42) between a retracted storage position and an extended position. A back plate (16) connects rearward ends of the arms (12, 14) and a wrist rest (26) connects forward ends of the arms (18, 20) such that the assembly may be varied in width and length. A pair of keyboard supporting plate arms (22, 24) have forward ends pivotally coupled to forward ends of the arms (18, 20) and pivot between a horizontal orientation over the arms (18, 20) into a vertical or inclined position. A keyboard positioned upon the arms (22, 24) is thus pivoted therewith and maintains an orientation such that the keys of the keyboard face forwardly and remain accessible to the user throughout the range of motion.

23 Claims, 7 Drawing Sheets

KEYBOARD STORAGE DEVICE ASSEMBLY

BACKGROUND OF THE INVENTION

1. Field of the Invention

The subject invention relates generally to keyboard storage devices used in conjunction with computer desk-top systems and, more particularly, to such devices that incorporate a fold-up keyboard support member.

2. The Prior Art

A keyboard storage device assembly of the general subject type for use on a desk or a tabletop, credenza, or other work surface is a known product. The device stores the keyboard in a vertical or approximately vertical position in front of the monitor or computer CPU. The keyboard is attached to the top of a support top surface and folds upwardly from an extended position such that the keys face toward the monitor or CPU and the keyboard is thereafter moved toward the monitor into a storage position.

The primary advantage to such a device is to place the keyboard in a compact storage position against the monitor, freeing desk top space for other tasks. Such devices must, therefore, be compact, easy to use, and relatively inexpensive. In addition, since the size of computer monitors, keyboards, and other components can vary, the devices must accommodate a range of component sizes.

While the aforementioned devices work well, certain shortcomings attend their use. First, when the support top surface folds upwardly, the keys of the keyboard face inwardly toward the monitor and are thus unaccessible to the user. Stated alternatively, the bottom of the keyboard faces the user in the upright, storage position. A user cannot, therefore, if so desired, access the keyboard without pivoting the support out of the upright condition and into the horizontal, extended condition.

The keyboard, in known support assemblies, is therefore either completely accessible or completely unaccessible. In addition, the keyboard cannot be used in both a fully extended horizontal position and a partially retracted (inclined) position since the keys face away from the user as soon as the support is pivoted upward.

Lastly, from an aesthetic standpoint, the keyboard bottom faces outward in known supports when in the upright, storage condition. This visual appearance is less than desirable to many work station users.

SUMMARY OF THE INVENTION

The subject keyboard storage device assembly comprises a pair of spaced apart platform housings, each having an internal axial channel opening to a forward end. A pair of elongate extension arms reside within the housing channels, each moving axially forward and backward therein. A pair of elongate keyboard support plates are pivotally coupled to a forward end of the extension arms, each pivoting downward into a horizontal position over a respective extension arm, and pivoting upward into a substantially vertical orientation. The support plates move inward and outward with the extension arms.

The support plates include an upper flat surface for supporting a keyboard and the platform housings have an upper flat surface for supporting a computer monitor or the like. The keyboard pivots upward with the support plates and faces forward as the support plates, carried by the extension arm, is moved rearward toward the monitor. The extension arms can be moved rearward the limit of its travel or, alternatively, stopped short and the keyboard support plates inclined against the monitor. Throughout, the keys of the keyboard face forward toward the user and can be accessed whether in the vertical storage position or the partially stored, inclined position.

The storage device is adjustable in width to accommodated variations in the size of monitors and keyboards, and provides a wrist support at the forward end that accommodates such adjustment.

Accordingly, it is an objective of the subject invention to provide a keyboard storage device that renders the keys of a keyboard accessible to the user throughout a range of adjustment.

A second objective is to provide a keyboard storage device that moves a keyboard away from a user to free desk top space yet maintains the keys of the keyboard accessible throughout.

A further objective is to provide a keyboard storage device that is adjustable in width to accommodate variations in the size of keyboards and monitors.

Yet another objective is to provide a keyboard storage device that has an adjustably mounted wrist support at a forward end.

An additional objective is to provide a keyboard storage device providing for aesthetically pleasing display of the keyboard in the storage position.

A yet further objective is to provide a keyboard storage device that can be utilized in maintaining the keyboard in a partially removed, inclined, and useable condition.

Another objective is to provide a keyboard storage device that comprises a relatively few number of component parts; that is economically and readily manufactured; and that is readily assembled and convenient to use.

These and other objectives, which will be apparent to those skilled in the art, are achieved by a preferred embodiment that is described in detail below and illustrated in the accompanying drawings.

DESCRIPTION OF THE PREFERRED EMBODIMENT

Figure 1:
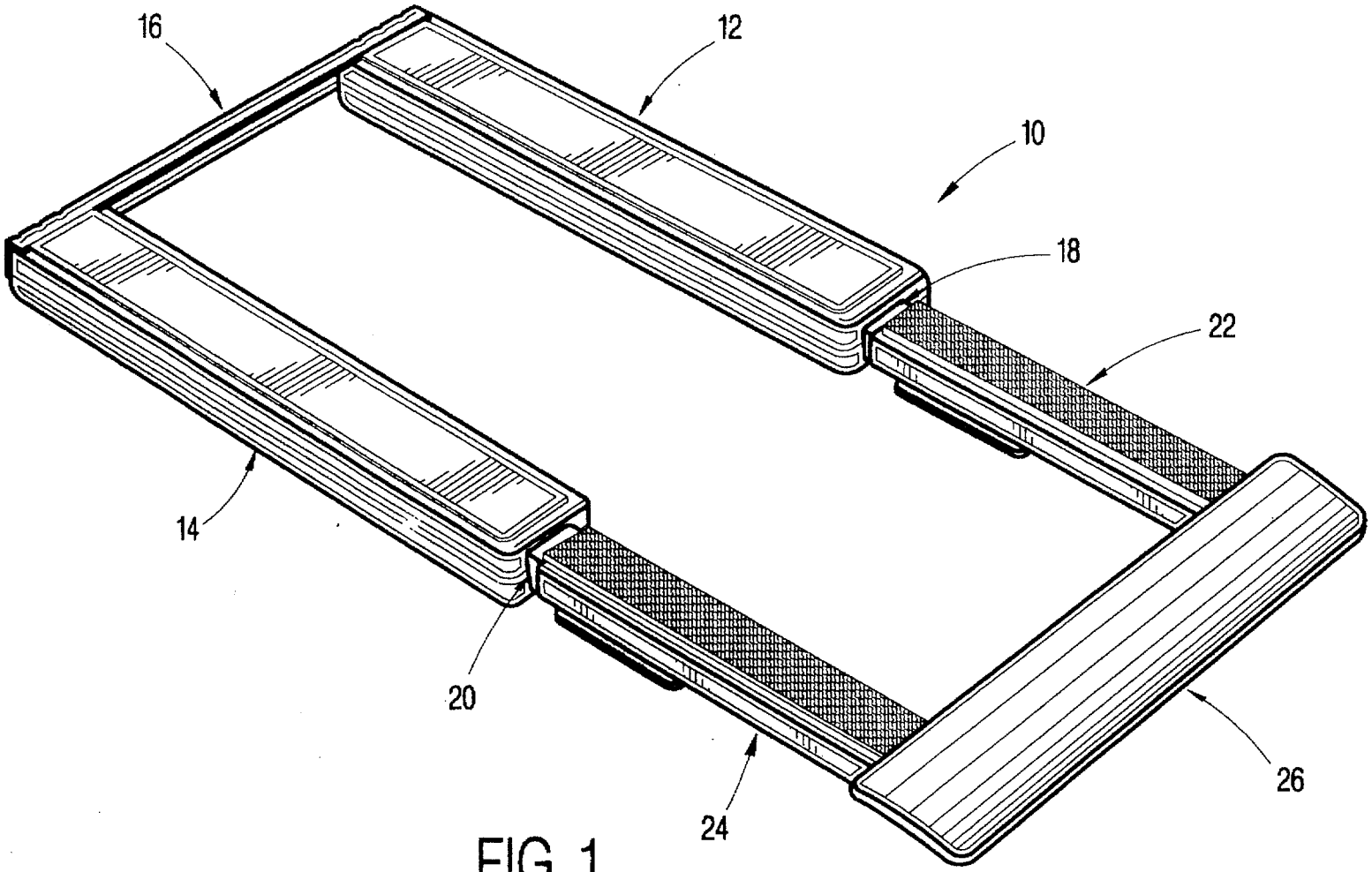
FIG. 1 is a front perspective view of the subject device assembly shown with the extension arms in the fully extended position.
Figure 2:
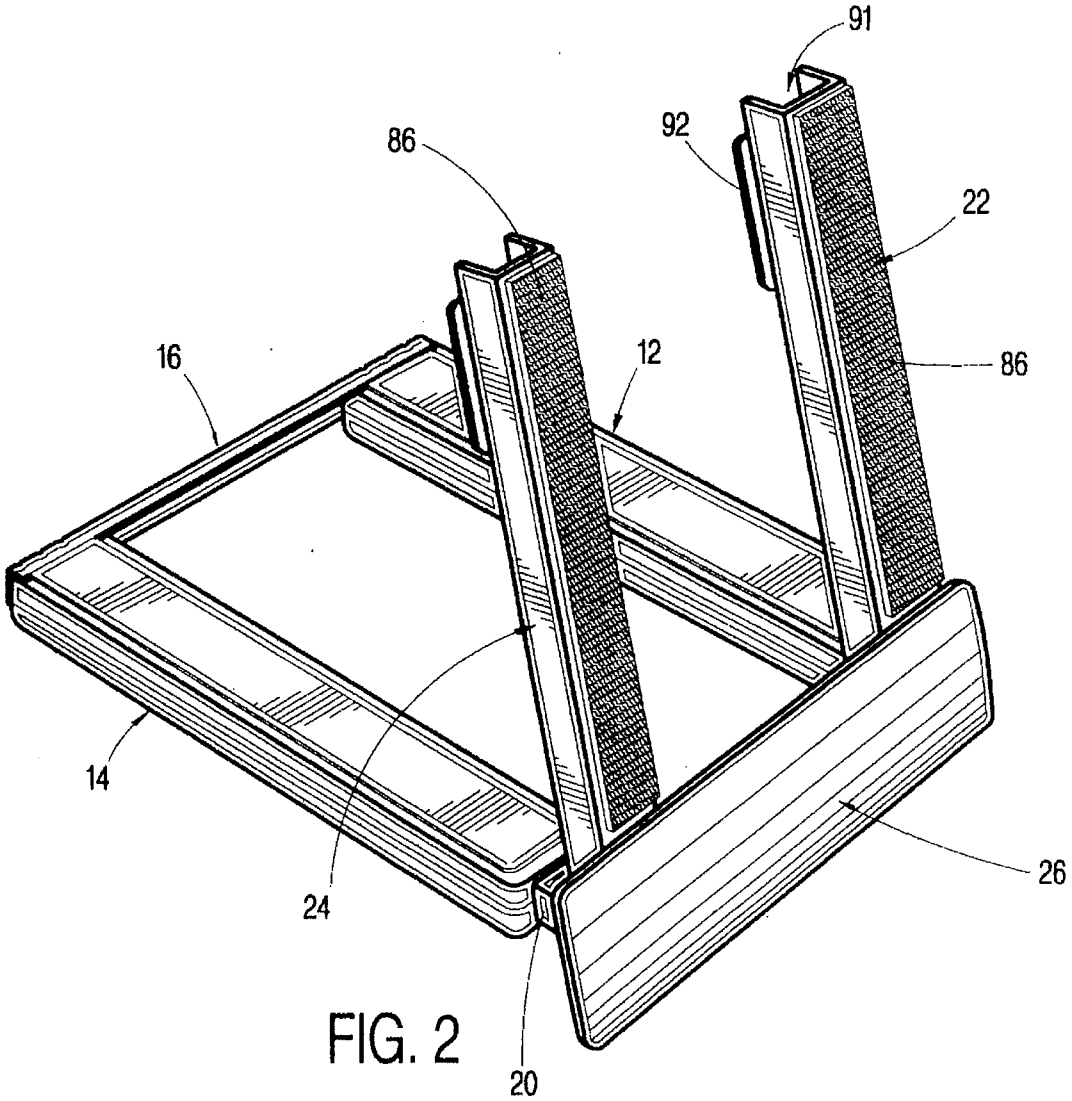
FIG. 2 is a front perspective view thereof shown with the extension arms in the fully retracted position.
Figure 3:
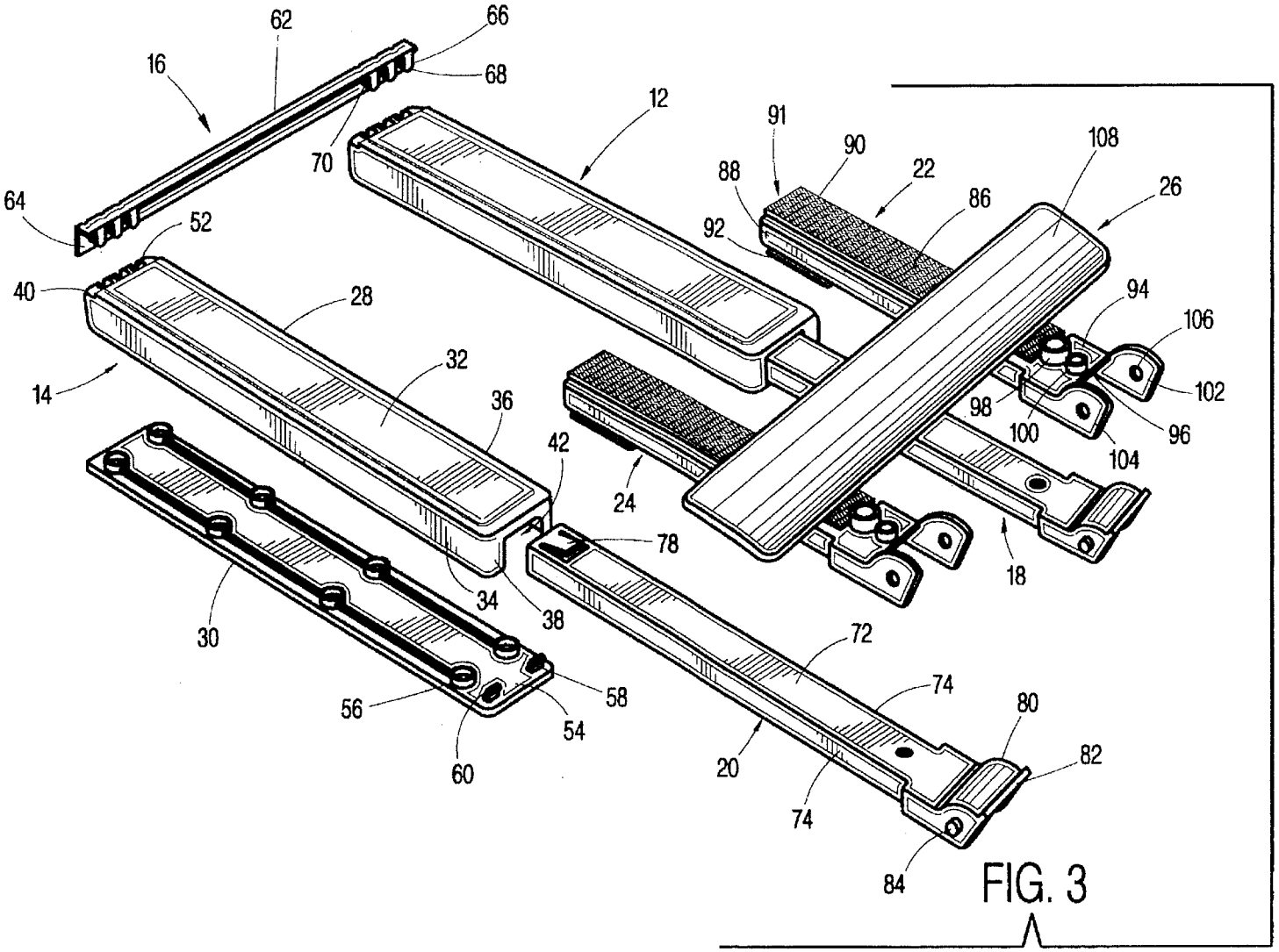
FIG. 3 is an exploded perspective view thereof.

Referring first to FIGS. 1, 2, and 3, the subject keyboard storage device assembly 10 is seen to comprise a pair of spaced apart platform housings 12, 14, a back plate 16, a pair of extension arms 18, 20, a pair of support plate arms 22, 24, and a wrist support 26. The components can be formed of various materials by conventional means, the preferred material being plastic material such as polypropylene formed by injection molding.

Figure 5:
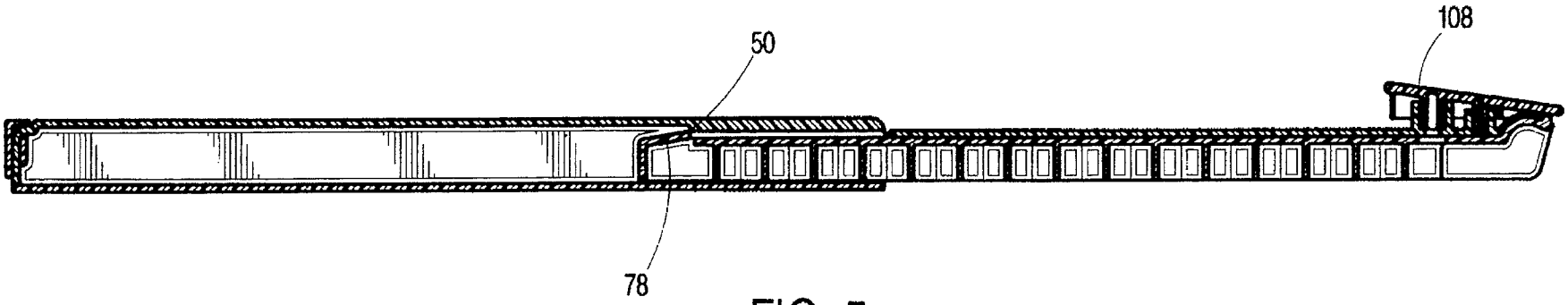
FIG. 5 is a longitudinal section view thereof taken along the line 5—5 of FIG. 4.
Figure 6:
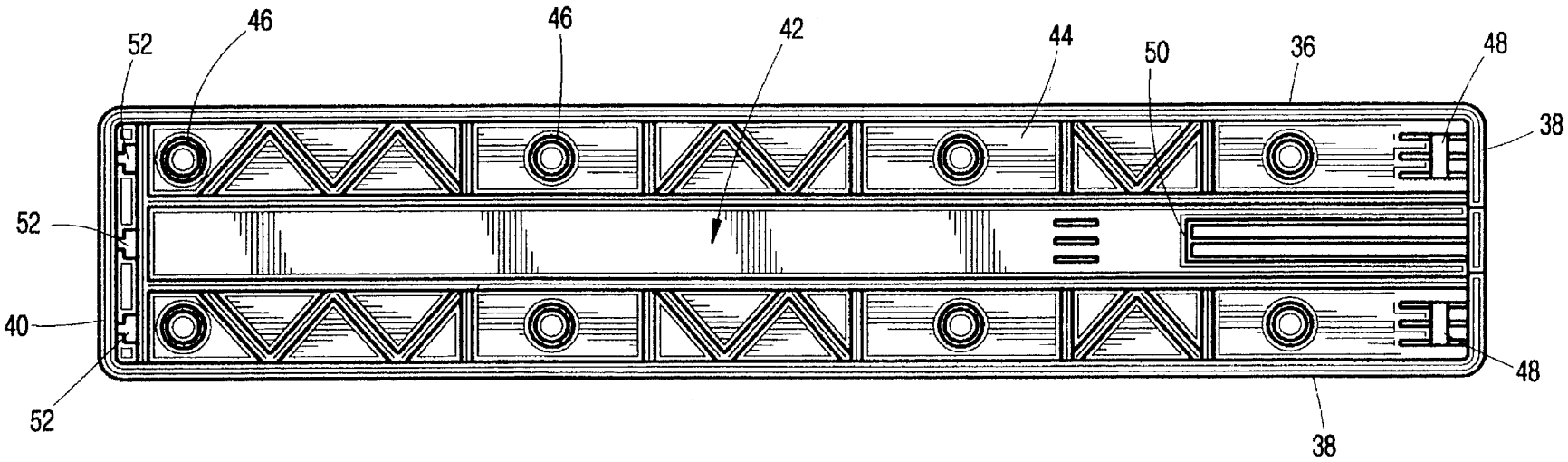
FIG. 6 is a bottom plan view of the upper component of the platform housing.

With reference to FIGS. 3, 5, and 6, each of the platform housings 12, 14 are identically formed by identical componentry, comprising a top housing 28 and a bottom housing 30. The top housing provides a planar top surface 32 that merges at its peripheral side edges with downturned side panels 34, 36; at its peripheral forward edge with a downturned forward panel 38; and at its peripheral rearward edges with downturned rearward panel 40. The top housing panels 34, 36, 38, and 40 define therebetween an elongate internal channel 42 that opens to the forward panel 40.

Figure 7:
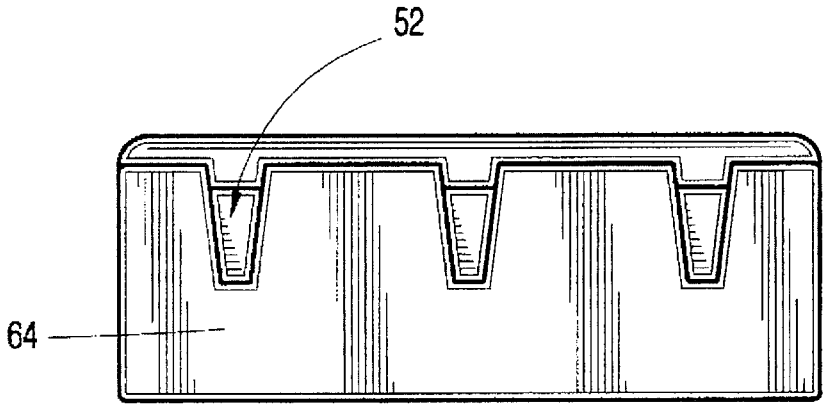
FIG. 7 is a forward end elevation view of the platform housing.

As best seen in FIG. 6, the underside 44 of the top housing 28 is provided with eight downward projecting cylindrical posts 46, spaced apart in rows of four on opposite sides of the channel 42. A downturned flange 50 extends transversely across the channel 42, positioned proximate to the channel's forward end. A pair of retention slots 48 extend into the underside 44, located proximate the forward panel 38. As shown in FIGS. 6 and 7, a series of three T-shaped slots 52 are positioned across the rearward panel 40, extending downwardly into the intersection of the rearward panel 40 and the top surface 32. The purpose of the slots 52 will be explained below.

With continued reference to FIGS. 3, 5, and 6, the bottom platform housing 14 is a generally flat, rectangular plate having an upper surface 54 from which eight cylindrical sockets 56 extend, positioned in spaced apart rows of four and corresponding in location to the posts 46 of the housing top 28. The bottom housing 14 further comprises a pair of locking tabs 58 projecting upwardly from the surface 54, and located forwardly to correspond in location with the retention slots 48 of the top housing 28.

The back plate 16 is of generally inverted L-shape, having a top surface 62 and a vertical rear surface 64. A series of three spaced apart, downward projecting T-shaped connector tabs 66 extend downward from the top surface 62, corresponding to the spacing between the slots 52 of the top housing 28. The connector tabs each comprise a relatively wide frontal plate 68 and a narrow neck portion 70.

Figure 4:
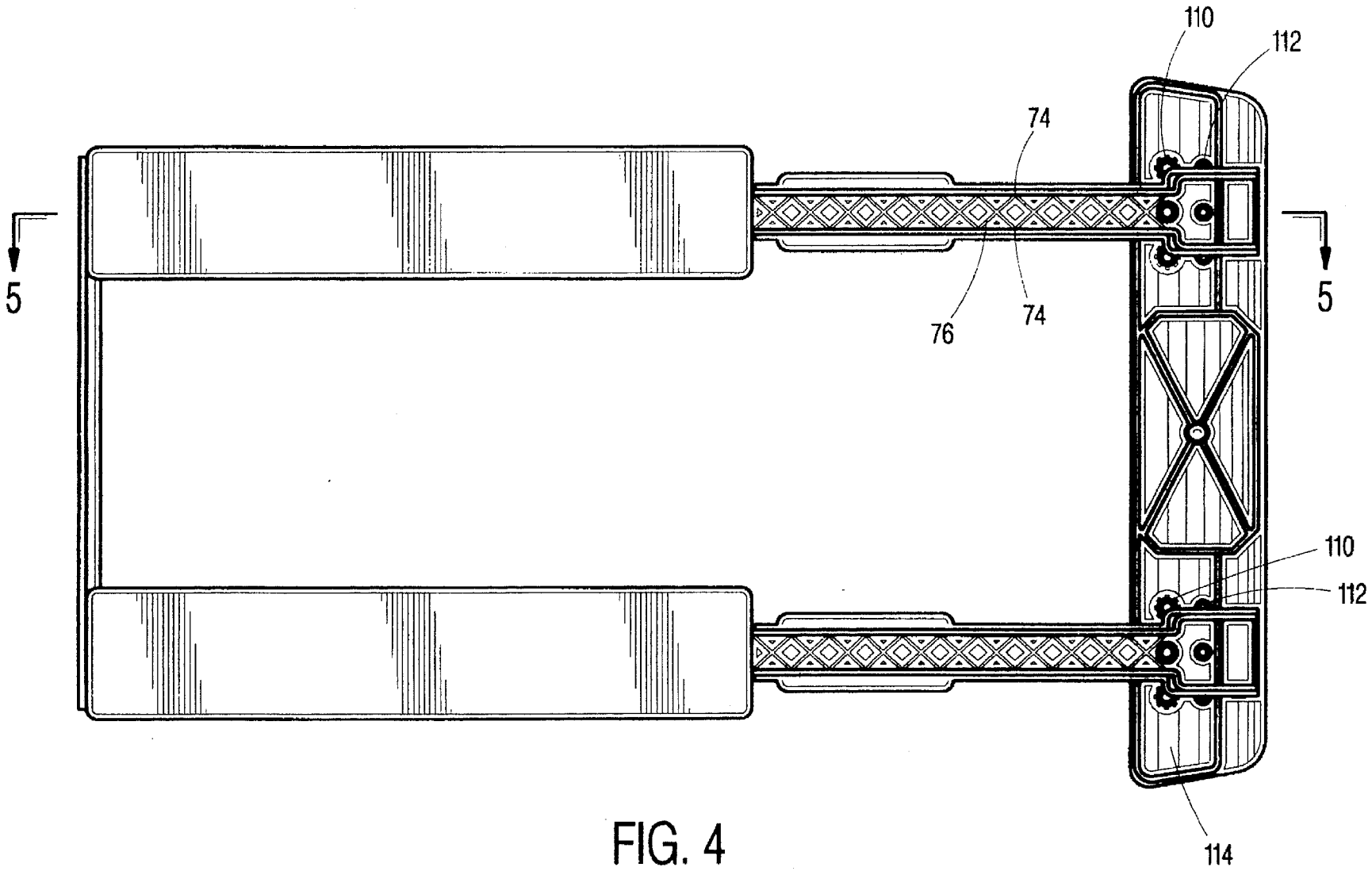
FIG. 4 is a bottom plan view thereof shown with the extension arms in the extended position.

Continuing, referring to FIGS. 3 and 4, the extension arms 18, 20 each are of identical configuration, and include a top surface 72 having side edges that merge into downturned sidewalls 74. The underside of the top surface 72 has a series of diagonal reinforcement flanges 76 therealong and a cantilevered locking tab 78 projects upward and forwardly from the top surface 72 proximate to a rearward end thereof. The top surface 72 merges into an arched, downwardly concave surface 80 at a forward end of each arm 18, 20. The arched surface 80 terminates at a forward end at an upturned transversely extending flange 82. A pair of cylindrical pivot pins 84 are formed to project outward from the forward end of the sidewalls 74, disposed generally below the arched surface 80.

Each of the support plate arms 22, 24 is configured to have a planar top surface 86 merging at longitudinal peripheral edges into downturned side walls 88, 90, which define therebetween a channel 91 that is open at forward and rearward ends. Along a portion of the lower edges of the side walls 88, 90 are outward extending feet 92. Toward the forward end, each arm 22, 24 widens into a planar bridge portion 94 that terminates at a forward arm edge 96. From the bridge portion, extending upward, are a relatively tall cylindrical post 98 and a shorter cylindrical socket 100. At the forwardmost end of each arm 22, 24 are spaced apart bracket arms 102,104, each bracket arm having a center through hole 106.

The wrist or palm rest 26 is of generally rectangular configuration, having a top support surface 108. As shown in FIGS. 5 and 6, the rest 26 is provided with a series of six elongate dependent cylindrical pins 110 and cylindrical sockets 112 positioned in dual rows of three each at opposite sides of underside surface 114.

Assembly of the subject invention proceeds as follows. The top housing 28 and bottom housing 30 of each platform housing subassembly 12 is assembled together as the posts 46 receive the sockets 56 therein in press fit fashion, while locking tabs 58 enter sockets 48 and end flanges 60 engage over edges defining the sockets 48. So connected, the channel 42 of each subassembly 12 is enclosed and opens to the forward end of the subassembly.

Thereafter, the support plate arm 22, 24 are pivotally assembled to a respective extension arm 18, 20 as the bracket arms 102, 104 straddle the forward ends of the extension arms and the pivot pins 84 enter into pivot holes 106 thereof. The support plate arms 22, 24, so assembled, can pivot upwardly into a substantially vertical orientation shown in FIG. 2, terminated by the engagement of edges 96 against the flanges 82 of the extensions arms 18, 20. The support plate arms 22, 24 can also pivot downwardly into the horizontal position depicted in FIG. 1, wherein the extension arms 18, 20 are closely received into the channels 91 of the arms 22, 24. The feet 92 of the arms 22, 24 engage and support the arms 22, 24 on a desk surface or the like.

The wrist support 26 assembles to the bridge portions 94 of the support plate arms 22, 24, and spans the arms 22, 24. The wrist support can attach to the arms 22, 24 in one of three width settings, with the setting being determined by the distance apart that the arms 22, 24 are to be maintained. The pins 110 of the wrist support 26 are received into the tall sockets 98 of the arms 22,24 in press fit manner, and the short sockets 112 are received into the short sockets 100 of the arms 22,24 in like manner. The attachment of the wrist support to the upper surface of arms 22, 24 enables the wrist support 26 to pivot unitarily with the arms 22, 24 between the aforementioned vertical orientation to the horizontal orientation.

The rearward ends of the extension arms 18, 20 are inserted into respective housing channels 42, and the arms 18, 20 move axially therein between a substantially fully inserted storage position, represented in FIG. 2, and a substantially fully withdrawn position, represented by FIGS. 1, 4, and 5. The arms 18, 20 are prevented from totally exiting the channels 42 by engagement of locking tab 78 against the stop flange 50 of the housing. The extension arms 18, 20 are otherwise free to move within the channels 42 between the inserted and withdrawn positions.

The back plate 16 assembles to the rearward panels 40 of the housing top 28, as T-shaped slots 52 receive the T-shaped tabs 66. The uniform spacing between the slots 52 and tabs 66 allows the back plate to be capable of attachment even if the spacing between the platform housing subassemblies 12, 14 is altered. That is, the assemblies 12, 14 can be brought closer or spread apart further and so long at least one pair of the tabs 66 are inserted into one pair of the slots 52, the two housings will be connected.

The consumer places the housings 12, 14 side by side, the distance therebetween being one of three distances. The choice of distance determines the which sockets 110, 112 of the wrist support 26 will engage the sockets 98, 100 of the support arms 22, 24, and which tabs 66 of the backplate and slots 52 of the housings 12, 14 will be utilized. The top surfaces 32 of the assemblies 12, 14 are intended to support a computer monitor or the like. By providing for an adjustable spacing between assemblies 12, 14, the subject stand can accommodate a range of monitor sizes thereon.

The subject invention is a keyboard storage device for use on a desk or tabletop. It stores a keyboard in a vertical or inclined position upon the top surfaces 86 of the support plate arms 22, 24 in the orientation of FIG. 2. The keyboard is attached to the support plates by fasteners such as velcro strips (not shown) that have one part adhesively attached to the underside of the keyboard and the other part adhesively attached to the surfaces 86. The keyboard, so attached, moves with the arms 22, 24 throughout their pivotal range of motion.

It will be appreciated that an upward pivotal movement of arms 22, 24 shown in FIG. 2, with the keyboard upon surfaces 86, orients the keyboard such that the keys are upright and facing forward of the assembly, toward the user. The keyboard in such a position is still accessible to the user and can be manipulated. Thereafter, the extension arms 18, 20 can be pushed into their respective housings 12, 14 and into the fully inserted, storage mode depicted in FIG. 2. The desk surface portion formerly occupied by the arms 18, 20 and the keyboard is thus cleared for alternative use.

The wrist support 26 pivots with the arms 22, 24 into a vertical orientation as well, and moves rearward to the position shown in FIG. 2. Throughout its pivotal reorientation into a vertical position, and movement into the storage position of FIG. 2, a keyboard will face forwardly and be accessible. In fact, in the storage position of FIG. 2, a keyboard can still be accessed by the user. The advantages to the user is aesthetic, since the keyboard top facing forward is more attractive than its underside, and functional in that the keyboard can be used in either a fully extended horizontal position (FIG. 1), a fully retracted position (FIG. 2), or a partially retracted (inclined) position (not shown). The partially retracted or inclined position is achieved by allowing the arms 22, 24 to incline rearwardly, leaning against a monitor positioned upon the housings 12, 14. In this position, desk top surface area is partially cleared but the keyboard remains useable.

It will be noted that the housing arms 12, 14, the extension arms 18, 20, the back plate 16, the arms 22, 24, and the wrist support 26 form a parallelogram of unique function. In the broadest sense, the parallelogram is adapted to be variable in width (moving arms 12, 14 and 22, 24 closer or farther away) and length (moving the arms 22, 24 into and out of the arms 12, 14). The configuration of the back plate 16 and wrist support 26 allow for such modification. The invention further provides for a spatial plane (defined as the surfaces 86 of the arms 22, 24 and the space therebetween) to face upward or forward throughout the range of adjustment, and to be adjustable in width with the arms 18, 20. Thus, the present invention, while being preferably used as a keyboard support device, can find application anywhere such a configuration is advantageous. By way of example, without limitation, the subject stand can be used as a copy or book holder and allow for inward and outward movement toward the reader, and for allow for variation in the copy or book width. Another alternative use can be as an adjustable writing surface.

While the above describes the preferred embodiment and several alternative uses of the subject invention, the invention is not intended to be so limited. Other embodiments, which will be apparent to those skilled in the art, and which utilize the teachings herein set forth, are intended to be within the scope and spirit of the subject invention.

We claim:

1. A keyboard storage device assembly for computer keyboards, comprising:

at least one elongate extension arm having a rearward end and a forward end;

at least one platform housing having an elongate channel that receives the rearward extension arm end therein and the extension arm moves within the channel from a storage position substantially within the channel to an extended position forward of the channel;

at least one keyboard support plate having a forward end pivotally coupled to the forward end of the extension arm, and the keyboard support plate has a top surface for supporting and positioning a keyboard thereon between the extension arm forward end and the platform housing; and the top surface pivots with the support plate from a substantially horizontal orientation into a substantially more vertical storage orientation in which the top surface and the keyboard thereon face forwardly.

2. A storage assembly according to claim 1, wherein the extension arm axially moves within the platform housing channel into the storage position carrying the support plate in the vertical orientation and the support plate top surface in a forward facing position.

3. A storage assembly according to claim 2, wherein further comprising means for securing the keyboard to the support plate top surface.

4. A storage assembly according to claim 2, wherein the support plate includes attachment means for attaching the support plate to the extension arm in the horizontal orientation.

5. A storage assembly according to claim 4, wherein the attachment means comprising a downwardly opening elongate channel adapted to receive the extension arm therein as the support plate is pivoted into the horizontal orientation.

6. A storage assembly according to claim 2, wherein the platform housing includes an upper surface adapted to support a computer monitor thereon.

7. A storage assembly according to claim 6, wherein the support plate is positionable in an inclined orientation against the computer monitor with the extension arm substantially within the support plate platform channel.

8. A storage assembly according to claim 7, wherein further comprising an elongate wrist support bar connected to the forward end of the keyboard support plate and extending perpendicularly thereto, and the wrist support bar moves in unison with the keyboard support plate toward and away from the platform housing.

9. A storage assembly according to claim 8, wherein the wrist support bar has an upper surface positioned above the keyboard support plate upper surface.

10. A keyboard storage device assembly for a computer keyboard comprising:

at least first and a second elongate extension arms extending in a parallel and spaced apart orientation, each extension arm having a rearward end and a forward end;

first and second platform housings, each having an elongate channel for receiving the rearward ends of the first and the second extension arms therein respectively, and the extension arms axially move in unison within the channels from a storage position substantially within the channels to an extended position forward of the channels; and a first and a second keyboard support plate, each having a forward end pivotally connected respectively to the forward ends of the extension arms, the keyboard support plates having substantially coplanar top surfaces for supporting a keyboard thereon between the forward ends of the extension arms and the platform housings; and the top surfaces pivot with their respective support plates from a substantially horizontal orientation into a substantially more vertical storage orientation in which the top surfaces and the keyboard face forwardly.

11. A storage assembly according to claim 10, wherein the extension arms axially move within the platform housing channels into the storage position carrying the support plates in the vertical orientation and the support plate top surfaces in a forward facing position.

12. A storage assembly according to claim 11, wherein further comprising means for securing the keyboard to the top surfaces of the support plates.

13. A storage assembly according to claim 11, wherein the support plates each include attachment means for attaching to the extension arms in the horizontal orientation.

14. A storage assembly according to claim 13, wherein the attachment means comprising a downwardly opening elongate channel adapted to receive an extension arm therein as the support plate is pivoted into the horizontal orientation.

15. A storage assembly according to claim 14, wherein the platform housings each has an upper surface adapted to support a computer monitor or the like thereon.

16. A storage assembly according to claim 15, wherein the support plates are positionable in an inclined orientation against the computer monitor with the extension arms substantially within the support platform housing channels.

17. A storage assembly according to claim 16, wherein further comprising an elongate wrist support bar connected to the forward ends of the keyboard support plates and extending perpendicularly thereto, and the wrist support bar moves in unison with the keyboard support plates toward and away from the platform housings.

18. A storage assembly according to claim 17, wherein the wrist support bar has an upper surface positioned above the upper surfaces of the keyboard support plates.

19. A storage assembly according to claim 18, wherein the spacing between the extension arms and the keyboard support plates is adjustable within a specified range of adjustment.

20. A storage assembly according to claim 19, wherein the wrist support bar comprises adjustable attachment means for connecting to the forward ends of the keyboard support plates throughout the range of adjustment.

21. A storage and display device assembly comprising:

a parallelogram configured body comprising:

spaced apart first and second forwardly disposed extension arms;

spaced apart first and second rearwardly disposed housing arms, the housing arms being separated by a distance variable within limits and each having a forwardly opening channel adapted to receive one of the extension arms therein, the extension arms reciprocally moving within the channels between a retracted position substantially within the housing arms and an extended position substantially forward of the housing arms;

a back plate connecting rearward ends of the housing arms, the back plate having adjustment means for adapting to variation in the distance at which the housing arms are separated;

a front support plate connecting forward ends of the extension arms, the forward plate having adjustment means for adapting to variation in the distance at which the housing arms are separated; and a support surface pivotally coupled to a forward end of at least one of the extension arms and pivoting between a substantially horizontal orientation above the one extension arm and a substantially vertical orientation in which the support surface faces forwardly, the support surface moving with the one extension arm between the retracted and extended positions.

22. A device assembly according to claim 21, wherein further comprising at least one elongate support plate arm having a forward end coupled to the forward end of the one extension arm and the support plate arm moving with the support surface between the horizontal orientation and the vertical orientation, the support surface comprising an upper surface of the support plate arm.

23. A device assembly according to claim 22, wherein the support plate arm has an axial, downwardly opening channel sized to receive the one extension arm therein with the support plate arm in the horizontal orientation.

* * * * *